PTU28 XR 4,679,043

United States Patent [19]
Morokawa

[11] Patent Number: 4,679,043
[45] Date of Patent: Jul. 7, 1987

[54] METHOD OF DRIVING LIQUID CRYSTAL MATRIX DISPLAY

[75] Inventor: Shigeru Morokawa, Tokorozawa, Japan

[73] Assignee: Citizen Watch Company Limited, Tokyo, Japan

[21] Appl. No.: 566,075

[22] Filed: Dec. 27, 1983

[30] Foreign Application Priority Data

Dec. 28, 1982 [JP] Japan ..... 57-231476

[51] Int. Cl.[4] ..... G09G 3/36
[52] U.S. Cl. ..... 340/784; 340/805; 340/802
[58] Field of Search ..... 340/718, 719, 784, 805, 340/802, 812, 789

[56] References Cited

U.S. PATENT DOCUMENTS 4,019,178 4/1977 Hashimoto et al. ..... 340/805 X
4,281,324 7/1981 Nonomura et al. ..... 340/784
4,378,557 3/1983 Murata ..... 340/805
4,465,999 8/1984 Tsuzuki et al. ..... 340/805 X
4,532,506 7/1983 Kitazima et al. ..... 340/805 X

*Primary Examiner*—Gerald L. Brigance
*Attorney, Agent, or Firm*—Jordan and Hamburg

[57] ABSTRACT

A drive method for a liquid crystal matrix display panel whereby the display is driven as two or more separate regions, with each region being successively driven by row and column drive signals to display video data in a row-by-row manner during a drive phase while the remaining regions operate in a rest phase in which a potential substantially equal to zero is applied across the display elements of these other regions. The effective number of rows electrodes to which sequential scanning signal pulses are applied, which determines the level of contrast obtainable with such a display panel when the number of display elements is large, is made equal to the number of row electrodes of each of these regions, so that a sufficiently high number of elements for high-resolution television display is attainable with a simple display panel and peripheral circuit configuration.

9 Claims, 22 Drawing Figures

Fig. 6 (a) PRIOR ART
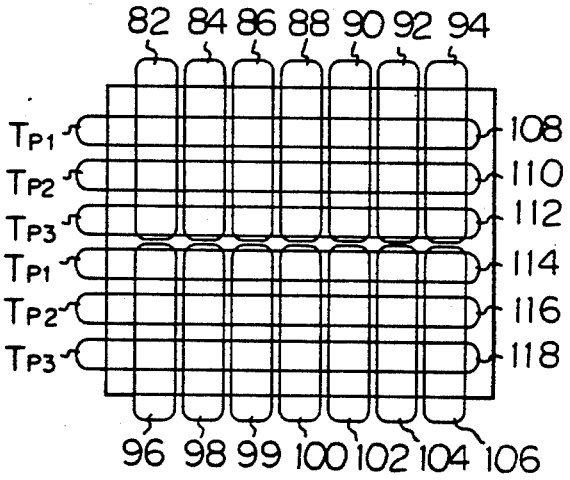
Fig. 6 (b)
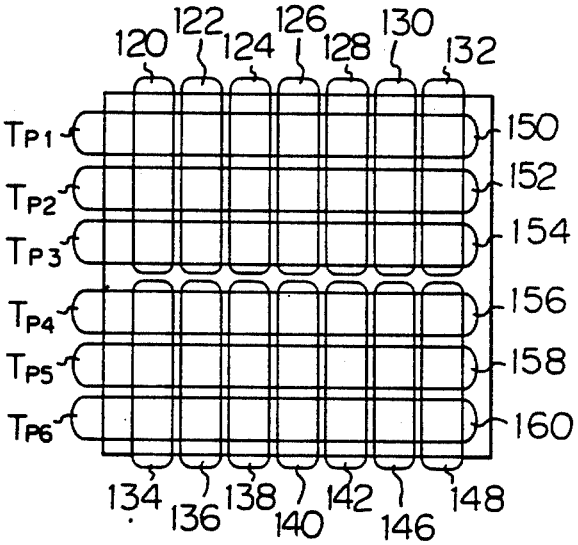

METHOD OF DRIVING LIQUID CRYSTAL MATRIX DISPLAY

BACKGROUND OF THE INVENTION

Liquid crystal matrix display panels possess certain significant advantages over CRT displays, with regard to low power consumption, thin shape, and potentially low manufacturing cost. However although liquid crystal displays are now in widespread use for such applications are wristwatch and portable calculator displays, large-size liquid crystal matrix display panels have not yet been produced in very substantial amounts. Such large-size liquid crystal matrix display panels could replace the CRT displays used in television receivers, computer terminals, etc, i.e. could display graphic or pictorial information, while bringing all the advantages of liquid crystal devices to such applications, including the important capability for operating with a very low level of supply voltage.

In general, it is necessary to provide some form of interface circuitry between a source of display data and the display device itself, i.e. to apply suitable drive signals in accordance with the display data to the display device. Moreover, if the rate of generation of the display data is different from the speed of operation of the display device, then it will be necessary to provide some form of memory means to temporarily store the display data before it is transferred to the display device. In the case of television reception, the duration of each horizontal scanning period (i.e. the period between successive horizontal sync pulses in the video signal) is equal to the time during which the CRT trace sweeps out a horizontal line of the displayed image. In this case, therefore, since the rate of input of the video data can be made equal to the speed of operation of the display device, it is not necessary to provide video data memory means. However in general, prior art drive methods for applying display data such as television video signals to a liquid crystal matrix display panel operate such that the speed of operation of the display panel is lower than the rate of input of video data, i.e. line-by-line scanning of rows of display elements in synchronism with the horizontal scanning periods of the video signal is not possible. Thus with such prior art drive methods it is necessary to provide video memory circuits in order to match the speed of operation of the liquid crystal matrix display panel to the rate of input of the video data. This is essentialaly due to the fact that it has hitherto been difficult to attain a sufficiently high degree of contrast using liquid crystal matrix display panels having a very large number of display elements such as is required to display a television image.

This limitation on display element number due to display contrast consideration is essentially determined by the number of electrodes of the liquid crystal matrix display panel to which periodic scanning pulses are applied, as described in detail hereinafter. With the drive method of the present invention, the effective number of these electrodes for a given number of display elements can be greatly reduced, e.g. to one-half or one-third, without a reduction in display contrast. The drive method of the present invention therefore makes it possible to produce low-cost, low power-consumption liquid crystal matrix display systems which can directly replace CRT displays in such applications as television or computer graphic displays, utilizing simple peripheral interface circuits and with no necessity to provide large-capacity video data storage means.

SUMMARY OF THE INVENTION

With the drive method of the present invention, a liquid crystal matrix display panel is driven as a plurality of separate regions, e.g. as an upper half and a lower half. In the latter case, with periodic scanning signal pulses being successively applied to a set of row electrodes of the display, and drive signals representing display data being applied to column electrodes, two independent sets of column electrodes would be provided to drive the upper and lower halves of the display respectively, each driven by a separate column electrode drive circuit. While the upper half of the display is operating in a mode referred to as the drive phase, with drive signals applied to the column electrodes thereof and with row scanning signal pulses successively applied to the row electrodes to sequentially select the rows of display elements of that upper half, the lower half of the display operates in what is referred to as a rest phase, with a potential substantially equal to zero being applied across each liquid crystal display element of the lower half of the display matrix. When sequential scanning of the row electrodes of the upper half has been completed, then that half of the display matrix enters the rest phase, while the lower half of the display matrix enters the drive phase, with drive signals representing display data now being applied to the column electrodes thereof and with the row electrodes thereof being successively scanned, from top to bottom. In this way, the row electrodes of the display matrix are successively scanned during each display frame in a line-by-line manner, as for a television raster scan, so that it is possible to apply drive signals derived from line-at-a-time video data directly to the column electrodes. That is to say, while video data to be displayed in the upper half of the display matrix is being input, then this is transferred by suitable switching circuit means to drive circuits of the column electrodes of the upper half of the display matrix while the lower half of the display matrix is operating in the rest phase, while when video data to be displayed in the lower half of the display matrix thereafter is input, this is transferred to the drive circuit of the column electrodes of the lower half of the display matrix, while the upper half of the display now operates in the rest phase.

The operation of the drive method of the present invention is similar in the case of the display matrix being driven as three or more regions. In each case, while one region is operating in the drive phase (i.e. with selection and AC bias drive signals being applied to the display elements of that regions), a potential substantially equal to zero is applied across each display element of the remaining regions, which are in the rest phase. As a result, the effective number of row electrodes of the display matrix (more specifically, the number of row electrodes which is utilized to calculate the ratio of Von/Voff of each liquid crystal display element) is made equal to the number of row electrodes of each of the regions described above. Thus, the level of contrast of a display utilizing the drive method of the present invention in which the display matrix is divided into upper and lower regions is equivalent to that of a display matrix having twice the number of display elements which is driven by a conventional drive method, i.e. a method which does not divide the display matrix into a plurality of independent regions for drive purposes.

The drive method of the present invention is distinguished from prior art drive methods which drive different regions of the display matrix independently from one another in that with such methods it is necessary to utilize a large-capacity video memory, when the number of display elements is large and video data having a line-by-line scanning format is to be displayed, since with such prior art methods it is not possible to synchronize the video input data with scanning of the rows of the display matrix. Thus it is difficult to provide low-cost liquid crystal display systems with such prior art drive methods. The drive method of the present invention can be used to implement inexpensive liquid crystal matrix display systems which can directly replace CRT systems for such applications as television or computer terminal displays.

BRIEF DESCRIPTION OF THE DRAWINGS

FIGS. 6(*a*) and 6(*b*) are plan views for illustrating a prior art liquid crystal matrix display drive method in which different display regions are drive by separate column electrode drive signals, and an embodiment of a display matrix utilizing the drive method of the present invention;

FIGS. 8(*b*) and 8(*c*) are waveform diagrams for illustrating the operation of the liquid crystal matrix display system of FIG. 8(*a*);

FIGS. 9(*b*) and 9(*c*) are waveform diagrams for illustrating the opration of the liquid crystal matrix display system of FIG. 9(*a*);

DESCRIPTION OF THE PREFERRED EMBODIMENTS

Figure 1A:
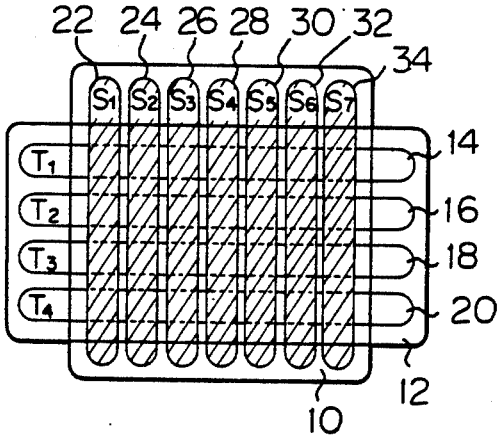
Fig. 1(a) PRIOR ART
FIGS. 1(*a*) and 1(*b*) are a plan and cross-sectional view respectively of a nematic type of liquid crystal matrix display panel.
Figure 1B:
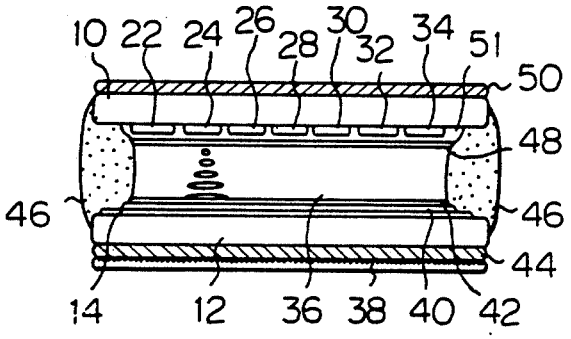
Fig. 1(b) PRIOR ART
Figures 2A, 2B, 2C:
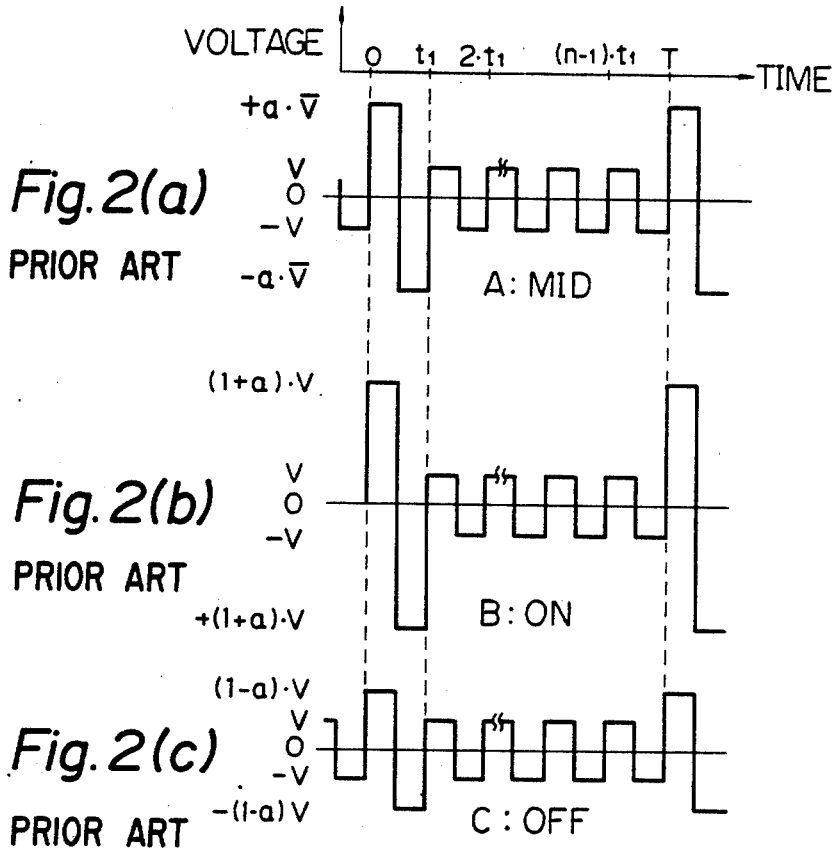
Fig. 2(a) PRIOR ART
Fig. 2(b) PRIOR ART
Fig. 2(c) PRIOR ART
FIGS. 2(*a*) to (*c*) are waveform diagrams for illustrating a prior art drive method for a liquid crystal matrix display panel.
Figure 3:
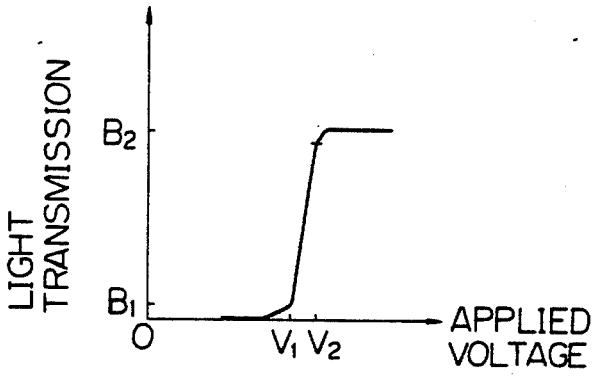
FIG. 3 is a graph illustrating the relationship between light transmission and applied voltage for a liquid crystal display element.

FIG. 1(*a*) is a simplified plan view of the arrangement of horizontal electrodes 16 to 20 (referred to in the following as row electrodes) and vertical electrodes 22 to 34 (referred to as segment electrodes) of a liquid crystal matrix display panel 12. FIG. 1(*b*) is a cross-sectional view of the matrix display panel and FIG. 2 shows typical drive signal waveforms applied to a display element of the matrix, with FIG. 2(*a*) showing the drive signal applied to a display element which is set in a condition of intermediate transparency, FIG. 2(*b*) showing the drive signal applied to a display element which is set in a fully transparent condition (referred to in the following as the ON state), while FIG. 2(*c*) shows the drive waveform applied to a display element which is set in the completely non-transparent state (referred to herein as the OFF state). In order to prevent dissolution of the liquid crystal it is necessary to apply drive potentials of alternating polarity to the elements of such a matrix display panel, as shown in FIG. 2. The liquid crystal matrix display panel is assumed to be of the twisted nematic type, which displays a relationship between threshold voltage level V1 and saturation voltage level V2 as shown by the characteristic curve in FIG. 3. Here, the transparency of a display element is plotted along the vertical axis and applied voltage along the horizontal axis. Thus, in order to provide a display having a number of density gradations, it is necessary to vary the level of drive voltage applied to the display elements within the range V1 to V2 shown in FIG. 3, to thereby provide variations in display density within the range B1 to B2, i.e. the range of minimum to maximum transparency.

In FIG. 1(*a*), numeral 12 denotes a lower glass plate, with transparent row electrodes 14 to 20 being formed on the upper surface of plate 12. Such optically transparent electrodes can be formed of a material such as a thin film of a metallic oxide such as $Sn_2O_3$, or $In_2O_3$, or as a high-polymer thin film of a material such as polyacetylene $(—CH)_x$, or polycyadyl $(—SN)_z$. Numeral 10 denotes an upper glass plate, which also has transparent electrodes (e.g. column electrodes 22, 28, . . . ) formed on the surface thereof which faces glass plate 12. Numerals 51 and 40 denote transparent insulating films formed of a material such as $SiO_2$, which prevent direct contact between the liquid crystal material 36 and the drive electrodes, to thereby prevent a DC current from flowing in the liquid crystal when drive voltages are applied to the electrodes. These insulating films also serve to produce sufficient flatness of the electrode surfaces. Numerals 48 and 42 denote liquid crystal alignment layers, which serve to align the molecules of the liquid crystal such as to provide a nematic liquid crystal alignment as is well known in the art, e.g. with the major axes of the molecules arranged parallel to the planes of glass plates 12 and 10, but with the molecules adjacent to each plate being aligned in mutually perpendicular directions as viewed perpendicular to the display plane. However various other arrangements of the liquid crystal molecules can be utilized.

Numerals 50 and 44 denote polarizing plates, which serve to establish mutually perpendicular directions of polarization of light transmitted through them. Numeral 38 denotes a reflector plate.

Figure 4A:
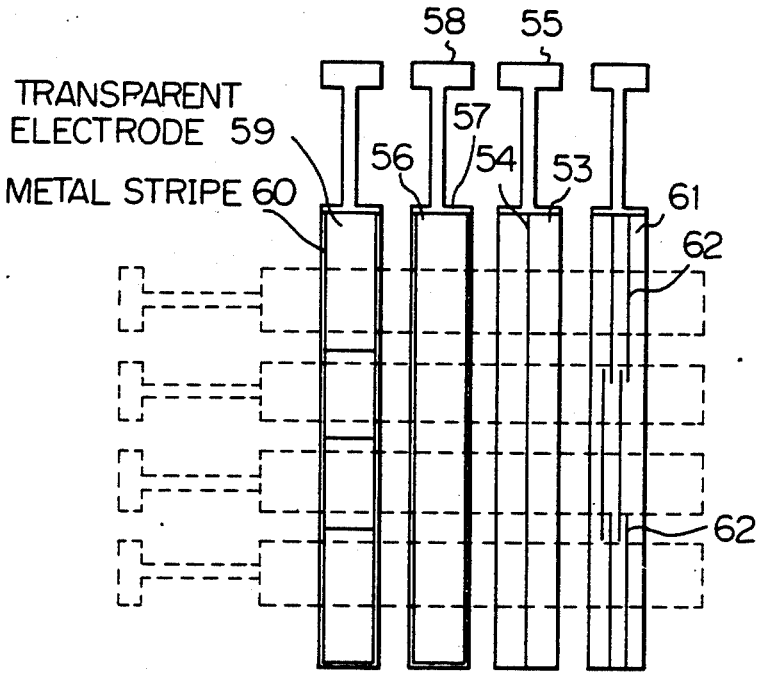
FIGS. 4(*a*) and 4(*b*) are plan and cross-sectional views for illustrating a method of providing thin metallic stripes upon transparent electrodes.
Figure 4B:
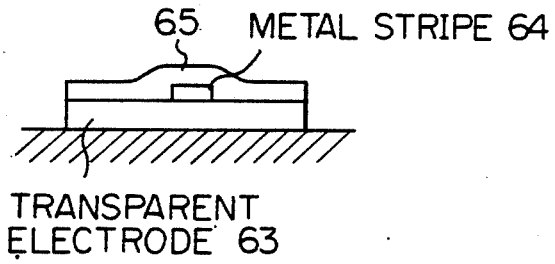

In order to improve the electrical conductivity of the transparent electrodes used in such a liquid crystal matrix display panel, means have been adopted such as providing a fine line or stripe of metal such as copper along the length of the electrode, i.e. a thin, non-transparent line. This is illustrated in FIG. 4(*a*), in which a thin stripe of metal 54 is formed on a transparent electrode 53, extending from a connecting pad portion 55 of the electrode. However such an arrangement has the disadvantage that the metal stripe portion will partially obscure each picture element of the corresponding row or column of display elements, thereby reducing the display quality of the liquid crystal matrix display panel. Thus it is difficult to make the metal stripe portion sufficiently wide to provide sufficiently increased conductivity of the electrode. An alternative arrangement is shown formed on a transparent electrode 56, i.e. a metal stripe portion 57 coupled to connecting pad portion 58 extends around the periphery of the electrode. This arrangement has the advantage of avoiding obscuring the display elements by the conducting metal stripe portions. However the present applicant has found that an arrangement such as that shown formed on transparent electrode 5 in FIG. 4(*a*) provides greatly improved results. In this case, cross-bar portions metal stripe 61 are formed between opposing portions of a peripherally formed metal stripe portion 60, with these cross-bar portions being positioned such as not to cover any portion of a picture element area. This permits a significant increase in conductivity of the electrode to be attained, while minimizing the effects of the electrode pattern upon the display quality. It should be noted that the conducting stripe pattern formed on electrode 5 can be formed on both the row and the segment electrodes of the matrix display panel, such that all of the conducting stripe portions are disposed in the spaces between adjacent display elements.

An alternative configuration which the present applicant has found advantageous is shown formed on a transparent electrode 62. Here, a plurality of mutually separate metal stripe portions 62 are formed extending in the direction of elongation of the electrode. By using a number of these separated metal stripe portions, each being sufficiently narrow in width, a substantial increase in conductivity of a transparent electrode can be attained with a minimum effect upon display quality.

FIG. 4(*b*) is a cross-sectional diagram to illustrate the manner in which such a metal stripe portion, designated by numeral 64, is formed upon a transparent electrode 63, with a transparent layer of an insulating material 65 (formed of a substance such as $SiO_2$) formed over these.

Referring again to the drive signal waveforms shown in FIG. 2, it will be assumed that these represent drive signals applied to the liquid crystal display element which is sandwiched between a column electrode 22 (i.e. an upper electrode) and row electrode 14 (i.e. a lower electrode). A display element is selected by the combined timing and data drive signals applied to these electrodes, i.e. to be set into the fully ON, fully OFF, or intermediate transparency state as described above. During the next time interval, from t1 to 2t1, the liquid crystal display element disposed between row electrode 16 and column electrode 22 is selected, while a non-selection cross-talk signal voltage of amplitude V is applied as an AC bias to the liquid crystal display element between row electrode 14 and column electrode 22. Thus, in the case of an liquid crystal matrix display panel having a total of n rows, the amplitude of the drive voltage required to set a display element in the fully ON state, designated as Von, and the drive voltage required to set a display element in the fully OFF state, Voff, can be calculated from the following (assuming a peak amplitude of 1 for the timing signal pulses applied to the row electrodes and designating the peak value of a column electrode drive pulse as (a):

$$V\text{on} = \sqrt{\{(1+a)^2 \cdot 1 + 1^2 (n-1)\}/n}$$

$$V\text{off} = \sqrt{\{(1+a)^2 \cdot 1 + 1^2 \cdot (n-1)\}/n}$$

$$(n,a) = V\text{on}/V\text{off} = \sqrt{\{(1+a)^2 + n - 1\}/(1-a)^2 + n - 1)}$$

As the number of rows n is increased, the values of Von and Voff approach one another. In order to make the value of Voff correspond to the value V1 shown in FIG. 3, and to make the value of Von correspond to the value of V2, it is necessary to suitably determine the value of amplitude a. However as the value of n is increased, it becomes impossible to attain such a drive voltage relationship. The ratio Von/Voff, i.e. a, has a maximum value:

$$\alpha = \sqrt{(\sqrt{n}+1)/(\sqrt{n}-1)}$$

As the number of rows n is increased, and $\alpha$ approaches a value of 1, the value of Von becomes greater than V1, and the value of Voff becomes smaller than V2, so that display contrast is lowered. For a value of n of the order of 32 to 64, the ratio Von/Voff=V2/V1, approximately. Thus, problems of lowered contrast will arise if the number of rows n in the display matrix is made higher than 64.

When a simple liquid crystal matrix display panel of the basic form shown in FIG. 1(*a*) is utilized to provide a television display, for example, then each row of display elements is successively driven by applying video signal potentials corresponding to each element of that row to the respective column electrodes 22 to 34, during an interval when a timing pulse is being applied to the row electrode of that selected row, then applying the appropriate video signal potentials for the next row of display elements to the column electrodes when a succeeding timing pulse is being applied to the next row electrode, and so on, i.e. with these timing pulses successively scanning down the row electrodes 14 to 20.

Figure 5:
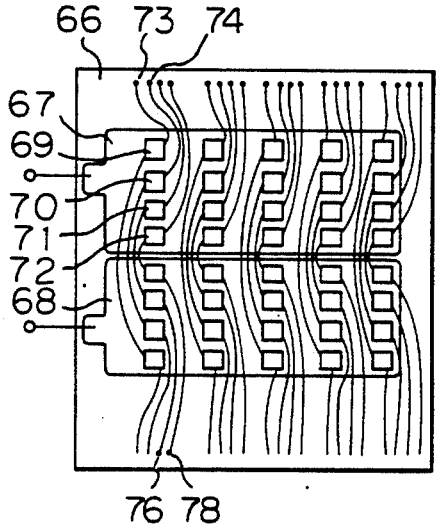
Fig. 5 PRIOR ART
FIG. 5 is a plan view of a portion of a liquid crystal matrix display panel to illustrate a method of multiplexing the drive signals applied thereto.

One method which has been proposed to enable the number of rows of such a liquid crystal matrix display panel to be increased is to utilize multiplexing of the drive signals, i.e. to drive a plurality of rows of display elements by each of the row electrodes, through suitable time-sharing driving of the row electrodes. A simple example of such an arrangement is illustrated in FIG. 5, in which multiplexing by a factor of four is performed (i.e. each row electrode drives four rows of display elements). Here, a liquid crystal matrix display panel 58 is provided with with a pair of row electrodes 67 and 68, and five sets of four column electrodes, the first of which are designated by numerals 58 to 78. These column electrodes in conjunction with row electrode 67 drive the set of four display elements 69 to 72. At first sight, the matrix of FIG. 5 appears to form an 8 row by 5 column array of display elements. However in fact the number of electrode connecting lines which must be lead out from the matrix is equal to (2+20)=22, rather than the total of 13 leads which would be required in the case of a simple 8 by 5 row matrix which does not employ multiplexing drive. Thus the number of electrode connection leads is identical to that of a simple 2 row by 20 column matrix. The increased number of lead-out conductors made necessary by such a multiplexing drive arrangement will present practical problems of manufacture, in the case of a matrix display panel having a large number of column electrodes such as is required to provide a television display.

Another method which has been proposed for increasing the total number of rows in such a liquid crystal matrix display panel beyond the practical limit of approximately 64 as described above, is illustrated in FIG. 6(*a*). Here, the column electrodes are divided into an upper set, 82 to 94, for driving the upper half of the display matrix, and a lower set 96 to 106 for driving the lower half of the matrix, while corresponding ones of the row electrodes in the upper and lower halves are connected together (i.e. row electrodes 108 and 114, 110 and 116, 112 and 118 as shown). When such a display matrix is utilized with a line-by-line scanning drive arrangement, e.g. for television display, then the operation for the first three rows driven by row electrodes 108 to 112 will be identical to that of the simple display matrix of FIG. 1(*a*) as described above, i.e. timing pulses designated as TP1 to TP3 will successively scan the row electrodes 108 to 112, with video signal potentials being applied to the column electrodes 82 to 94 suitably synchronized with these row scanning pulses. While the upper half of the display matrix is being driven in this way, video signals are also applied to the lower set of column electrodes 96 to 106, which are electrically separate from column electrodes 82 to 94, and the row electrodes 114, 116, and 118 of the lower half are driven in synchronism with upper row electrodes 108, 110 and 112 respectively. That is to say, while both of row electrodes 108 and 114 are being driven simultaneously by timing pulse $T_{P1}$, video data for the uppermost row of display elements of the upper region of the display is applied to column electrodes 82 to 94, while at the same time video data for the uppermost row of display elements of the lower half of the display is applied to column electrodes 96 to 106. Subsequently, row electrodes 110 and and 116 are simultaneously driven by timing pulse $T_{P2}$ while video data for the second row of display elements in each half of the display is applied to column electrodes 82 to 94 and 96 to 106, respectively, and so on.

Such an arrangement has a number of advantages. Firstly, the effective number of rows with regard to the value of Von/Voff defined hereinabove is equal to the number of rows in each half of the matrix. Thus, by providing 64 rows of elements in each half of the display matrix, for a total of 128 rows, the value of Von/Voff is held close to V2/V1 (of FIG. 3), so that no loss of contrast results from the doubled number of matrix rows. Secondly, two sets of column electrode connecting leads (i.e. for the upper and lower halves of the display matrix) can be led out from the matrix display panel in a very convenient manner. However, since row electrodes in the upper and lower halves of the display matrix are driven simultaneously (e.g. 108 and 114), it is necessary to ensure that the appropriate video signals are applied to the column electrodes in a correspondingly simultaneous manner, (e.g. to simultaneously apply to column electrodes 82 to 94 the segment drive signals for the row of display elements corresponding to row electrode 108 and apply to column electrodes 96 to 106 the segment drive signals for the row of display elements corresponding to row electrode 114, during row scanning pulse TP1). However in the case of a television video signal, the data for each horizontal line of the display (in the case of a CRT display) or each row of display elements is supplied in a line-at-a-time manner, i.e. during successive horizontal scanning periods. Thus, column electrode drive signals produced by processing such a video signal to provide suitable digital signals (utilizing shift registers and latch circuits as is well known in the art), for driving the display in a row-by-row sequential fashion, cannot be utilized directly with the arrangement of FIG. 6(*a*). It is necessary in such a case to provide two video data memory circuits coupled respectively to the column electrodes of the upper and lower halves of the display, in order to enable the appropriate video data signals to be applied to simultaneously drive the column electrodes of each half as described above, such that pairs of rows in the upper and lower halves of the display matrix are sequentially scanned (by scanning pulses TP1, TP2, TP3 in the example of FIG. 6(*a*)).

In the case of a television display, the amount of storage capacity required for these video memory circuits becomes extremely large. For example, considering a display matrix having approximately the minimum number of display elements required for television display, i.e with 128 rows and 128 columns, and with a gray scale comprising 16 brightness levels, the storage capacity required is found to be 64K bits. In the case of a 256 row by 256 column matrix, the storage capacity required is 256K bits. In addition, such a memory would require a very high read/write response speed capability (of the order of several MHz), and due to the high power consumption of a dynamic RAM memory of this type, would have to be formed of CMOS static RAM elements, with present-day technology. Such a video memory therefore would add very considerably to the expense of a television receiver in which it is utilized, and therefore would not be practical for a liquid crystal matrix display panel which is to be utilized in a comparatively inexpensive TV receiver, or is intended to provide an inexpensive direct replacement for a CRT in television or computer display applications.

Referring now to FIG. 6(*b*), the drive method of the present invention will be described. In this case, the display matrix column electrodes are again split into two sets 120 to 132, and 134 to 148, which define two separate regions of the display, i.e. the upper and lower halves in this example. However the row electrodes 150 to 160 of the matrix are not interconnected, but are scanned by sequentially generated timing signals TP1 to TP6. The set of column electrodes 120 to 132 and the set of column electrodes 134 to 148 are respectively coupled through changeover switch circuit means (not shown in FIG. 6(*b*)) to a column electrode drive circuit which produces drive signals representing video data in a line-at-a-time manner as described above. While the upper half of the display matrix is being scanned, by timing signal pulses TP1 to TP3, the display elements of the lower half are held in a condition in which a voltage of zero (or close to zero) is applied across each element, during a portion of the overall scanning field period referred to in the following as a "rest phase", with the column electrode drive signals being cut off from column electrodes 134 to 148 and applied only to column electrodes column electrodes 120 to 132. When scanning of the upper half of the display matrix has been completed, then the display elements of the upper half enter the resting phase, with column electrode drive signals being cut off from column electrodes 120 to 132 and supplied now to column electrodes 134 to 148.

Figure 7A:
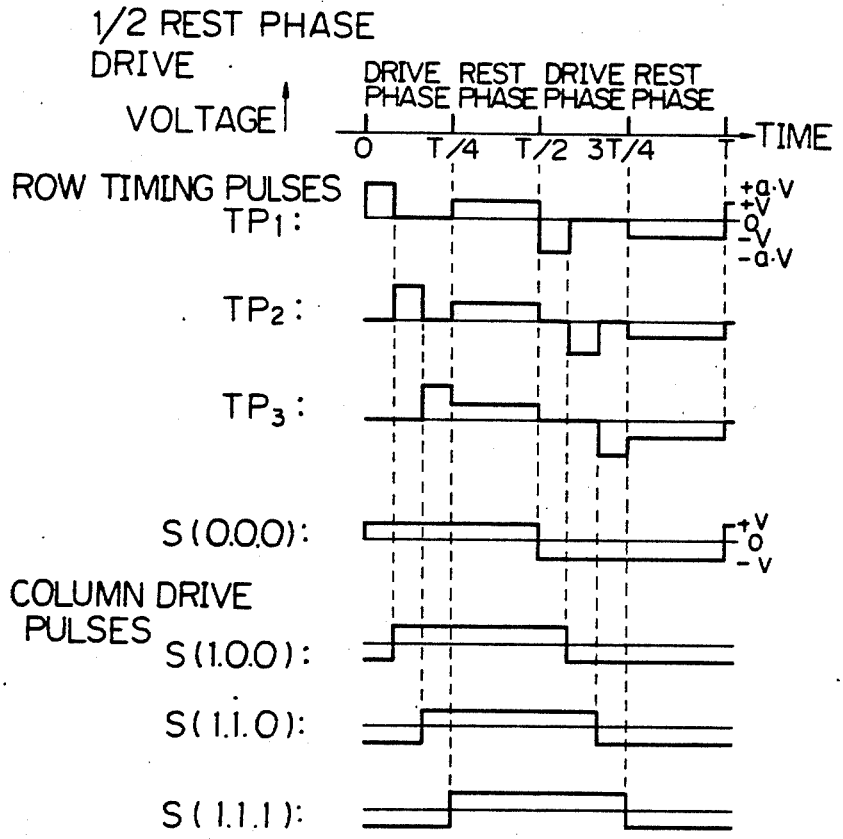
FIGS. 7(*a*), 7(*b*) and 7(*c*) wave waveform diagrams for illustrating different drive signal waveforms which may be utilized with the drive method of the present invention.
Figure 7B:
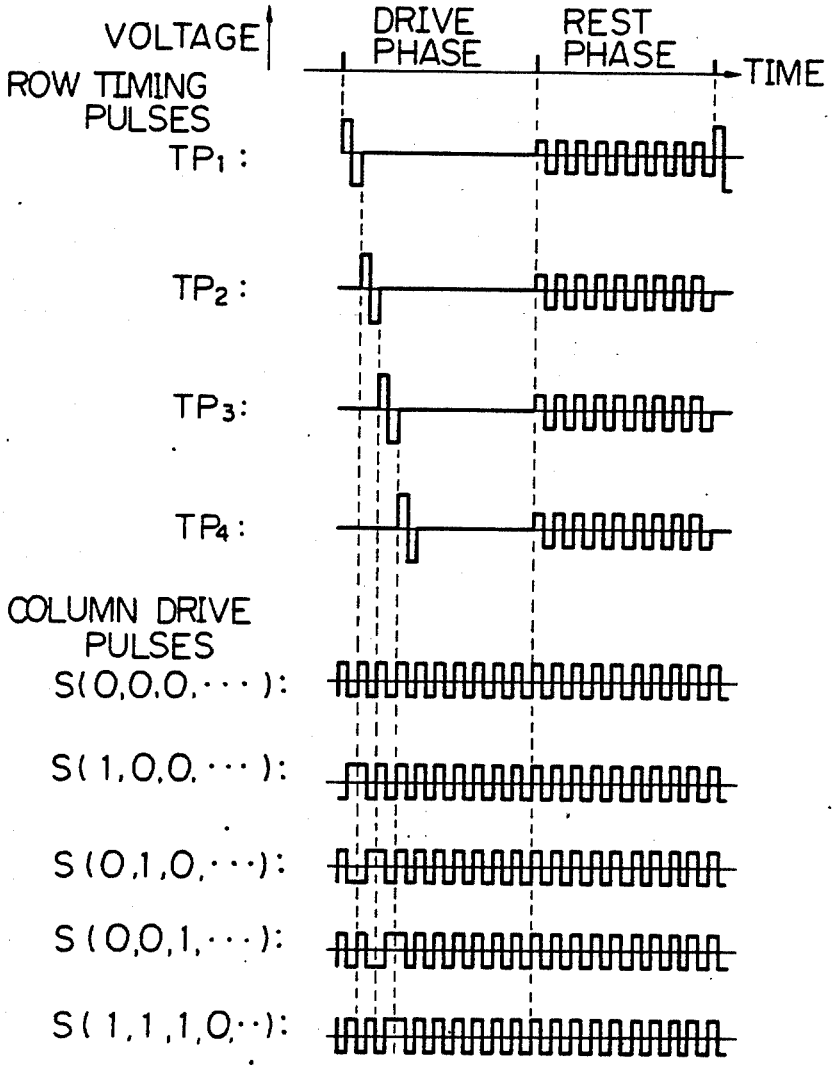
Figure 7C:
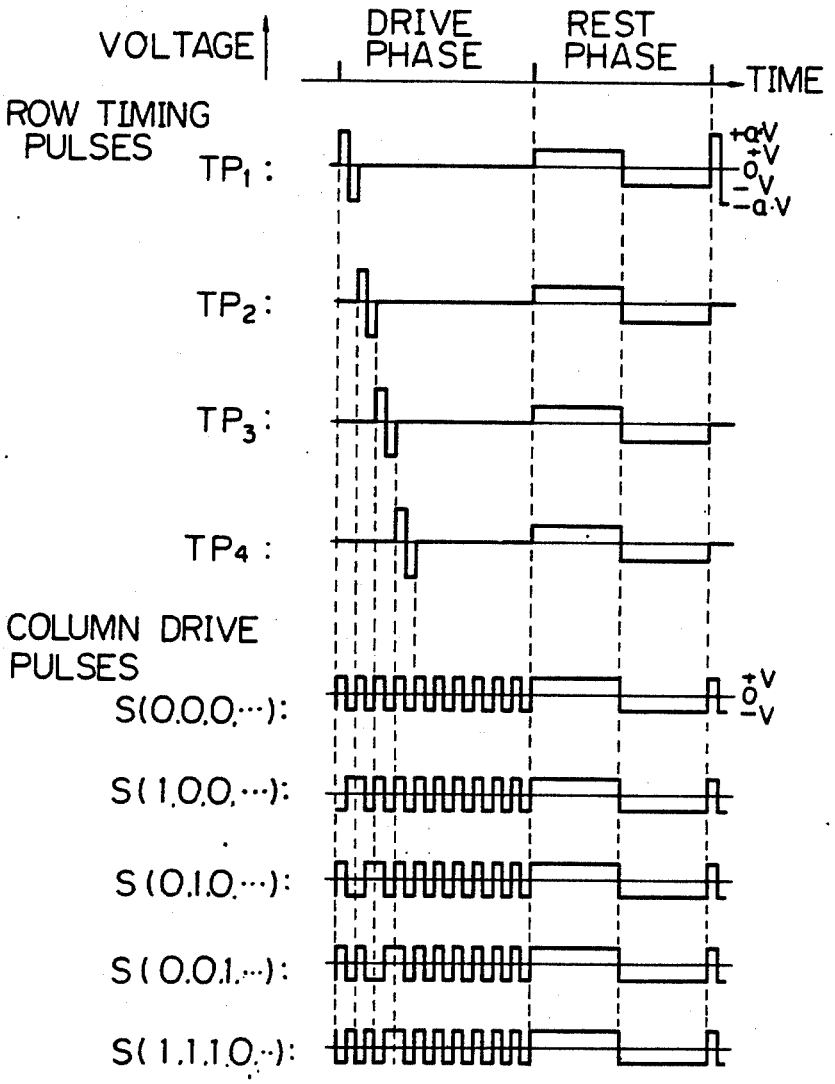

The drive method of the present invention, applied to the simple display matrix of FIG. 6(*b*) and assuming that each display element can take only two states, i.e. a fully ON and a fully OFF condition, is illustrated by the waveform chart of FIG. 7(*a*). Here, the timing signal pulses TP1, TP2, . . . can each take five different potential levels, as shown. Such a row electrode drive method provides certain advantages which are well known in the art and will not be discussed herein. FIG. 7(*a*) shows the row electrode drive waveforms TP1 to TP3 and three different possible column electrode drive signal waveforms, S(1,0,0) to S(1,1,1) for the upper half of the display matrix. As shown, the timing signal pulse waveforms vary in amplitude between +a.V and −a.V, while the column electrode drive waveforms vary between +V and −V. During a first drive phase, from 0 T/4, the rows of the upper half of the display matrix are successively selected by timing signal pulses TP1 to TP3, and the display elements driven in accordance with the column electrode drive signal contents. During time interval 0 to T/4, the lower half of the display is in a rest phase. Next, during the rest phase of the upper half of the display matrix from T/4 to T/2, a potential of +V is applied between the row electrodes and column electrodes to each display element in the upper half of the display element, while the lower half of the display matrix is scanned by timing signal pulses TP4 to TP5 (omitted from FIG. 7(*a*)). During the next drive phase of the upper half of the display matrix, drive signals of opposite polarity are applied to the row electrodes and column electrodes of that half, while the lower half of the display matrix enters a rest phase.

It will be apparent that with such a method, the rms value of drive voltage applied to each display element will be reduced, and it is therefore necessary to compensate for this by increasing the drive voltage amplitudes applied to the display matrix, e.g by a factor of $\sqrt{2}$, in the case of a display matrix split into two regions as in the example of FIG. 6(*b*). However such an increase will not normally present any practical difficulties.

In the above example, each display element enters the rest phase by having identical potentials applied to the corresponding row electrodes and column electrodes. However it is possible to use other methods of establishing the rest phase, e.g. by utilizing switching elements to produce a short-circuit state between row electrodes and column electrodes, etc. It is only necessary that means be provided for producing a potential substantially equal to zero across each display element in the rest phase. Also, the display may be divided into three or more regions, rather than two regions as in the example above. In each case, however, only the display elements of one region are driven at a time, by the drive method of the present invention, while the display elements of the remaining regions are in the rest phase.

FIG. 7(*b*) shows signal waveforms for a different system of drive signals applicable to the drive method of the present invention. Here, the timing signal pulses TP1, TP2, . . . alternate in polarity within short time intervals, rather than between successive drive phases as in the example of FIG. 7(*a*), as also do the column electrode drive signals shown in the lower part of the drawing. During a rest phase, the column electrode drive signals and the timing signal pulses comprise synchronized pulse trains of identical amplitude and polarity, so that the resulting drive voltages applied to the corresponding display elements are zero. The drive signals used in FIG. 7(*b*) will result in a higher level of power consumption, but have the advantage of applying reversals of polarity to the liquid crystal elements within shorter time periods than the signals of FIG. 7(*a*), and therefore are preferable from the aspect of maximizing the operating life of the liquid crystal elements.

FIG. 7(*c*) shows the waveforms of a different arrangement of drive signals applicable to the drive method of the present invention. During the drive phase, these signals are identical to those of the example of FIG. 7(*b*), however each rest phase is established by holding all of the timing signal pulses TP1 to TP4 of the corresponding display region fixed at a first potential during one-half of the duration of the rest phase, with the column electrodes of that region being held at the same potential (e.g. +V), then holding the potentials of these timing signal pulses fixed at the opposite potential (e.g. −V), together with the column electrodes, for the remainder of the rest phase. Here again, a potential of zero is applied to each display element of a region of the display maxtrix while that region is in the rest phase.

Figure 8A:
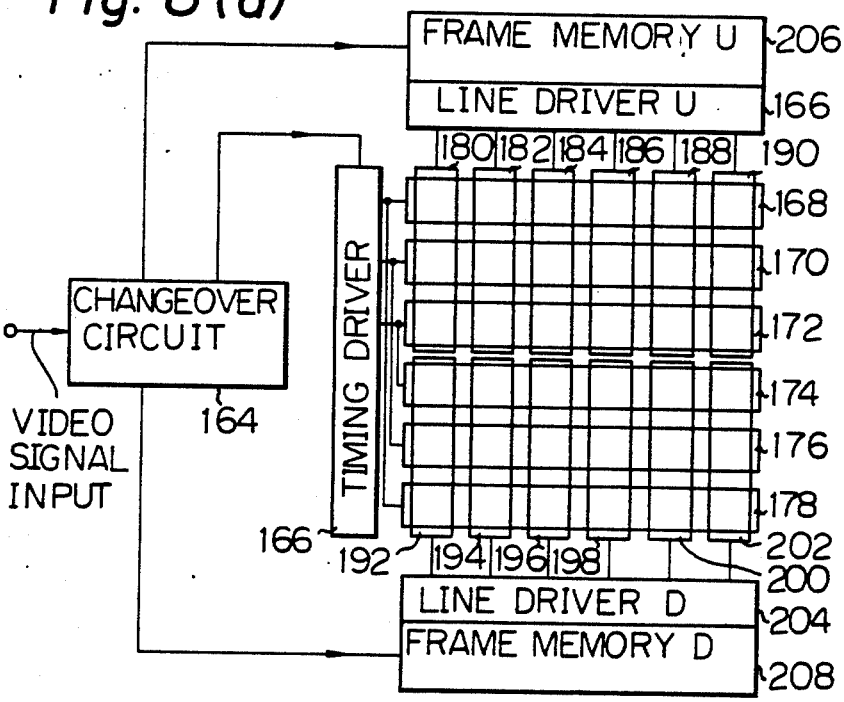
FIG. 8(*a*) is a block diagram of a prior art liquid crystal matrix display system similar to that of FIG. 6(*a*)
Figure 8B:
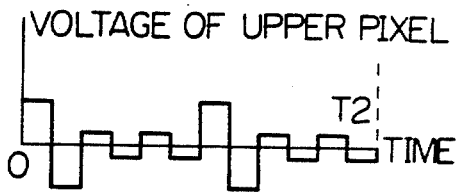
Figure 8C:
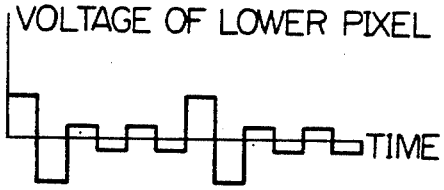

The drive method of the present invention will now be further described, referring to the block circuit diagram of FIG. 8(*a*) and the corresponding waveform diagrams of FIG. 8(*b*) and 8(*c*). In FIG. 8(*a*), a set of row electrodes 168 to 178 are arranged in connected pairs as in the example of FIG. 6(*a*), i.e. with row electrodes 168 and 178, 170 and 176, 172 and 174 being connected together, with these pairs of row electrodes being driven by timing signal pulses applied over three output lines from a row electrode drive circuit 166. The column electrodes are divided into an upper set, 180 to 190 and a lower set, 192 to 202, so that the display matrix is divided into an upper region and a lower region driven respectively by these two sets of row electrodes. The upper row electrodes 180 to 190 are driven by a column electrode drive circuit 166, and the lower set of row electrodes 192 to 202 are driven by column electrode drive circuit 204. A video signal is input to a changeover circuit (e.g. electronic switching circuit) 164, which selectively supplies the video signal to a frame memory circuit 206 which is coupled to provide inputs to memory circuit 166, and to a frame memory circuit 208 which supplies inputs to column electrode drive circuit 204. FIG. 8(*b*) illustrates a typical drive voltage waveform appearing across a display element in the upper region of the display matrix, while FIG. 8(*c*) shows the voltage appearing across a typical picture element in the lower half of the display matrix. The operation of this display system is as follows. During a time interval in which a portion of the video signal representing data to be displayed in the upper region of the display is input to changeover circuit 164 (e.g. during the first half of a horizontal scanning period), the video signal is transferred to memory circuit 206 and stored therein after being converted to digital form. When the next portion of the video signal, representing data to be displayed on the lower region of the display matrix is input to changeover circuit 164, then this is transferred to memory circuit 208 and stored therein. Thereafter, at the timing of a first timing signal pulse applied from row electrode drive circuit 166 to row electrodes 168 and 178, the column electrode drive signals for the first and sixth rows of display elements are output from driver circuits 166 and 204 respectively. Next, column electrode drive signals for the second and fifth rows of display elements are output from the column electrode drive circuits, and so on.

Figure 9A:
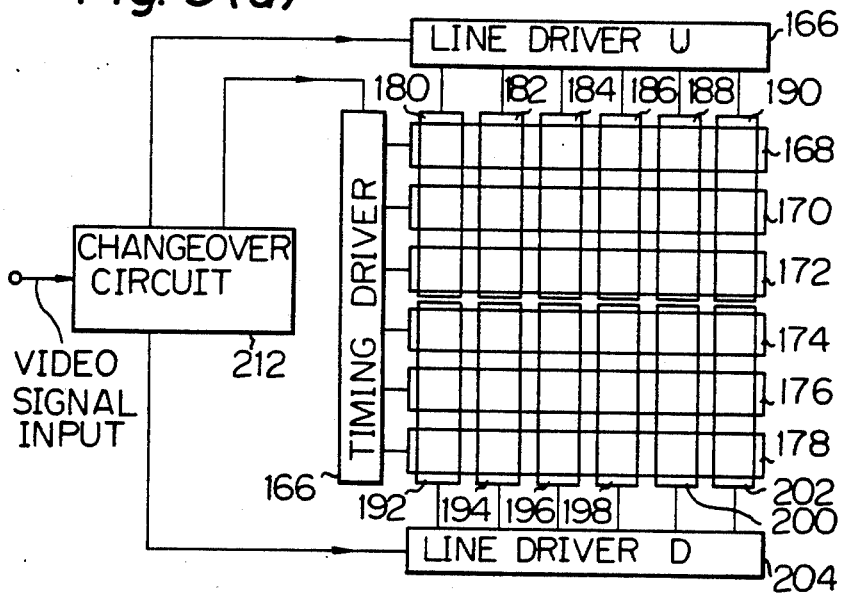
FIG. 9(*a*) is a block diagram of an example of a liquid crystal matrix display system employing the drive method of the present invention.
Figure 9B:
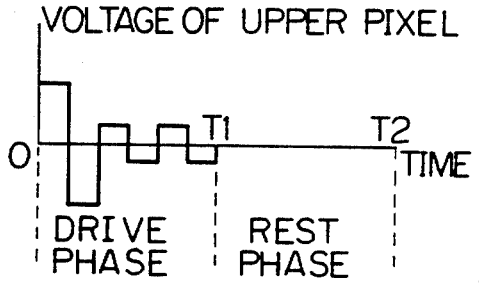
Figure 9C:
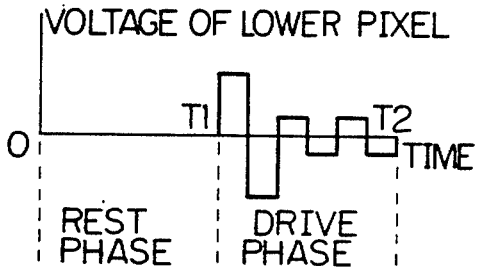

FIG. 9(*a*) shows a block circuit diagram of a liquid crystal display system utilizing the "rest phase" drive method of the present invention. As in the circuit of FIG. 8(*a*), the display matrix is divided into an upper and a lower region, with upper and lower sets of column electrodes i.e. 180 to 190 and 192 to 202 respectively. However the row electrodes are isolated from one another, and no frame memory circuit is required. When the video signal portion representing data to be displayed on the first (i.e. topmost) row of display elements is input to changeover circuit 212, the signal is transferred to column electrode drive circuit 166, and is output therefrom as drive signals applied to column electrodes 180 to 190. At this time, the upper region of the display is in the drive phase as shown in FIG. 9(*b*) which shows the voltage appearing across a typical picture element in the upper region, while the lower region is in the rest phase as illustrated by the drive waveform of FIG. 9(*c*). Thereafter, drive signals for the second and third rows of display elements are applied by drive circuit 166 to column electrodes 180 to 190. Upon completion of this stage, i.e. at time T1 shown in FIG. 9(*b*), the upper region of the display matrix enters the rest phase, while the lower region enters the drive phase. A potential of zero is thereafter applied across each display element of the upper region, as described hereinabove, and this condition continues until time T2. During the interval T1 to T2, drive signals are output from drive circuit 204 in synchronism with row electrode timing signal pulses applied to row electrodes 174, 176 and 178 in succession, to drive the fourth, fifth and sixth rows of display elements respectively. Thereafter, i.e. on completion of this scanning frame, the lower region of the display matrix enters the rest phase, and the sequence of operations described above is repeated.

In practice, it will be necessary to provide a certain amount of memory capacity to store video signal data before it is transferred to the column electrodes, in the case of a television display matrix using the drive method of the present invention. However the amount of storage capacity required is very small, corresponding at most to one or two lines of display elements. This is almost negligible, by comparison with the large amount of memory capacity required with the prior art method of FIG. 7.

Figure 10:
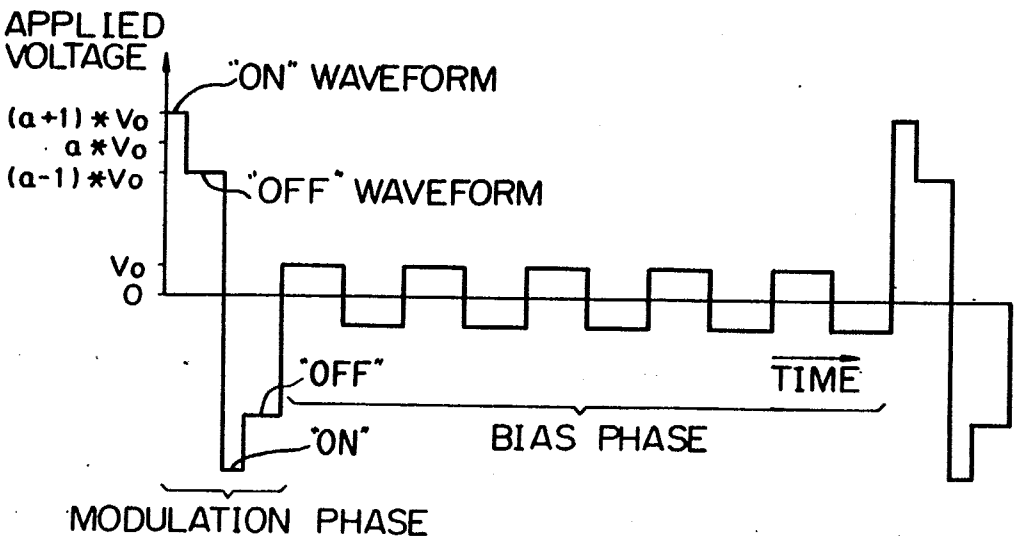
FIG. 10 is a waveform diagram for assistance in describing the operation of a liquid crystal matrix display panel which does not use the drive method of the present invention.

The drive voltage waveform appearing across a display element for the case of a typical prior art liquid crystal display matrix drive method is illustrated in FIG. 10. Here, the portion of each frame period during which a picture element is selected to be set in the ON or the OFF state is designated as the modulation phase, while the remaining portion of the frame during which a low-amplitude alternating polarity bias signal appears across the display element is designated as the bias phase, with the peak amplitude of this bias voltage being designated as V0. The peak drive voltage amplitude applied to set a display element in the ON state is designated as $(a+1)\cdot V0$, where a is the peak amplitude of the timing signal pulses applied to the row electrodes, and the voltage applied to set a display element in the OFF state is $(a-1)\cdot V0$. In this case, as described hereinabove, the effective, i.e. rms values Von and Voff for setting a display element in the ON and OFF states respectively are given as follows, with N denoting the number of rows in the display matrix:

$$Von^* = \underbrace{\sqrt{\frac{1*(a+1)^2 + (N-1-M)*1^2}{N}}}_{\text{modulation term}} \overbrace{\phantom{\sqrt{\frac{1*(a+1)^2}{N}}}}^{\text{bias term}} * V0$$

$$Voff^* = \sqrt{\frac{1*(a-1)^2 + (N-1-M)*1^2}{N}} * V0$$

Thus, the ratio of Von/Voff is given as:

$$A(N,a)^* = \frac{Von^*}{Voff^*} = \sqrt{\frac{a^2 + 2*a + N - M}{a^2 - 2*a + N - M}}$$

And the maximum value of this ratio is derived as:

$$A(N,M,a)^*\max = \sqrt{\frac{\sqrt{N-M} + 1}{\sqrt{N-M} - 1}}$$

Figure 11:
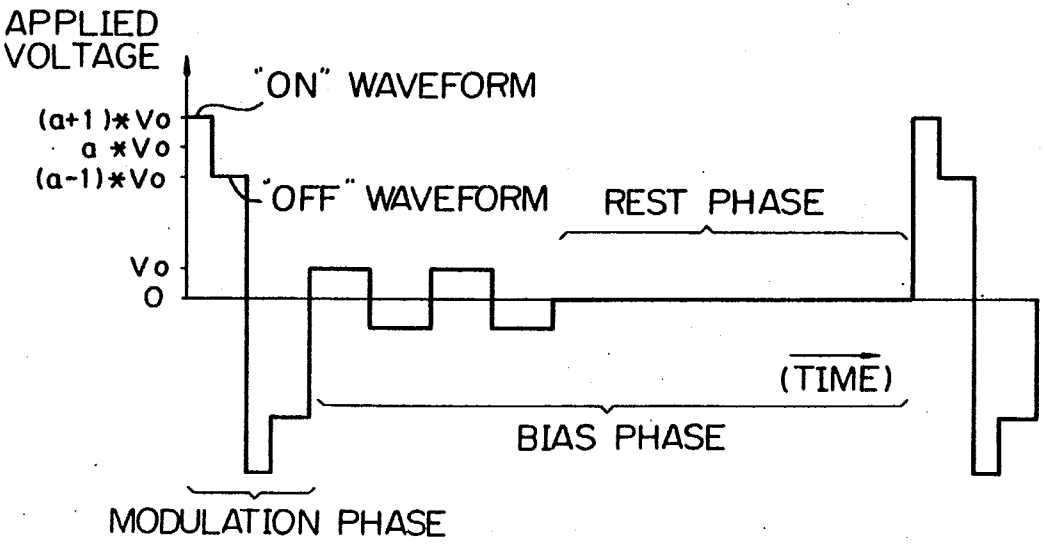
FIG. 11 is a waveform diagram for assistance in describing the operation of the drive method of the present invention.

Referring now to FIG. 11, the drive voltage waveforms appearing across a display element are shown for the case of a display matrix to which the drive method of the present invention is applied, with the matrix being divided into an upper and a lower region as in the example of FIG. 9(*a*) above. In this case the bias phase includes a rest phase portion, during which the potential applied across the display element is held at zero. A "rest factor" M is defined as representing the proportion of a frame during which display elements are in the rest phase. That is, if the matrix is divided into two regions as in the examples described above, then M will be equal to the total number of matrix rows N divided by 2. If the matrix is divided into three regions, then M will be N/3.

The values of Von and Voff are then given as:

$$Von = \underbrace{\sqrt{\frac{1*(a+1)^2 + (N-1)*1^2}{N}}}_{\text{modulation term}} \overbrace{\phantom{\sqrt{\frac{1*(a+1)^2}{N}}}}^{\text{bias term}} * V0$$

$$Voff = \sqrt{\frac{1*(a-1)^2 + (N-1)*1^2}{N}} * V0$$

and the ratio Von/Voff is given as:

$$A(N,a) = \frac{Von}{Voff} = \sqrt{\frac{a^2 + 2*a + N}{a^2 - 2*a + N}}$$

while the maximum value of Von/Voff is given as:

$$A(N,a)\max = A(N, \sqrt{N}) = \sqrt{\frac{\sqrt{N}+1}{\sqrt{N}-1}}$$

It can thus be understood that the maximum value of the ratio Von/Voff can be increased as required by the "rest phase" drive method of the present invention.

It should be noted that the drive method of the present invention can be combined with multiplexed drive of the electrodes, as described hereinabove with reference to FIG. 4, to obtain an even larger number of display elements without reduction of display contrast. For example, referring again to FIG. 4, such a matrix display could be expanded and formed into an upper-and-lower split display matrix, to comprise an upper set of 64 row electrodes such as 401 and 402 each driving a plurality of sets of four display elements, and a similar lower set of 64 row electrodes, with 768 sets of 4 column electrode connecting lead groups (such as the set 41 to 414 in FIG. 3) to drive the upper region of the display and a similar 768 sets of column electrode leads to drive the lower region. Such a liquid crystal matrix display panel would provide 768 columns by 512 rows of display elements, which is equivalent to the number of picture elements of the usual type of CRT television display.

It has been found that with the drive method of the present invention, performance can be enhanced (more specifically, the ratio Von/Voff of the liquid crystal display elements described hereinabove can be increased) by providing voltage-absorbing elements functioning at relatively low voltage levels, coupled between the display electrodes and the connecting leads thereof. As an example, pairs of back-to-back silicon diodes can be connected between each row electrode and the corresponding connecting lead which provides drive signals thereto. Such diodes can comprise for example pairs of amorphous silicon thin-film PIN junction diodes each connected in a ring configuration, or Schottky diodes formed using a thin film of material such as tellurium. This has the effect of reducing both the value of Von and Voff by an amount of the order of 0.5 to 1.5 V, thereby enhancing the effective ratio of Von/Voff. By utilizing such diode rings in conjunction with the drive method of the present invention and multiplexing of the drive electrodes as described above, it would be possible to produce an liquid crystal display matrix having a number of elements of the order of 1000×1000 to 4000×4000. By using such a large number of display elements, and by providing suitably positioned color filters over the display elements, it would be possible to provide a color display such as can be implemented using a CRT.

It should be noted that the provision of diode rings between the drive elements of a liquid crystal matrix display panel and the display elements, as described above, is to be distinguished from prior art schemes for providing diode or other elements coupled to the display elements of such a display, which produce a large magnitude of voltage absorption. With the arrangement described above, the amount of voltage absorption is very small, although highly effective, so that the AC bias voltage developed across display elements which are in the driven phase but not currently selected is reduced in magnitude, but is not made zero.

It can be understood from the above that the drive method of the present invention enables a substantial improvement to be made in the value of Von/Voff ratio, and hence display contrast, of a liquid crystal matrix display panel having a large number of display elements. As a result, this drive method enables a liquid crystal matrix display to be produced which can be directly coupled to receive a video signal such as is commonly input to a CRT type of display system, e.g. for computer or television display purposes, with the video data being transferred to the display matrix drive electrodes by simple and inexpensive signal processing and drive circuit means to be applied to drive successive rows of picture elements in a similar manner and with identical timing relationships to the line-by-line scanning of a conventional CRT television display. No large-capacity and expensive video memory circuit means are required, and since the liquid crystal matrix display panel does not include control elements coupled to each display element (i.e. is not of the "active matrix" type), such a matrix display system could be manufactured at low cost to provide a direct replacement for CRT displays used for television displays, computer terminal displays, etc. This has not hitherto been possible due to the high manufacturing cost of liquid crystal matrix display panels and peripheral circuits which utilize conventional drive methods, and the low degree of contrast attainable with such prior art methods when the number of display elements is made very large, e.g. of the order of magnitude required for television display.

In the case of an ultra-miniature type of liquid crystal matrix display panel which is of the order of several centimeters square, television images can be displayed with sufficient resolution by providing approximately 120×160 picture elements. Such an element configuration can be readily driven by the drive method of the present invention, using a split upper-and-lower (i.e. two-region) display configuration, e.g. as illustrated in FIG. 9(*a*). This can be combined with the display electrode multiplexing arrangement illustrated in FIG. 4, to provide the required number of drive electrodes for such a display matrix, together with ease of electrode and connecting lead layout, and a high value of aperture ratio, i.e. with a minimum amount of display area being obscured by electrode lines.

In order to provide a liquid crystal matrix display panel having a large number of display elements with high display contrast, without utilizing a drive method whereby large-capacity video memory means are required, it would normally be necessary to resort to high-level multiplexing drive of the electrodes, such as multiplexing by a factor of 8 (e.g., taking the example of FIG. 4, arranging that each row electrode drives 8 rows of display elements, so that each column of display elements is driven by column electrodes connected to a set of 8 separate connecting leads, rather than the 4 leads such as 66 to 78 in FIG. 4). Due to difficulties of forming the electrode patterns on the display panel substrates, such a high level of multiplexing would generally be impractical. However by utilizing the drive method of the present invention, for example with the display matrix divided into an upper and a lower region as illustrated in FIG. 9(*a*), the same number of display element rows could by driven using a multiplexing factor of only 4.

When implementing a drive method such as that of the present invention, it is necessary to take into account the display element array configuration and the drive signal waveforms. Referring again to FIGS. 7(*a*), 7(*b*) and 7(*c*), different types of drive signal waveforms are shown for a liquid crystal matrix display panel split into upper and lower regions and driven by the drive method of the present invention. If the display is divided into a greater number of regions, then the duration of the rest phase will increase accordingly. It should be noted that it is possible to divide the display into a number of regions which is not an integer.

In FIG. 7(*a*), timing signal pulses TP1 to TP3 have a five-level waveform, with the levels being settable independently, while the column electrode drive signals are of simple two-level type. The polarity of each timing pulse signal is inverted during each half-frame period, and one half of each period is a rest phase. The potentials of the timing signal pulses during the rest phase can be freely selected, so long as they are identical to those of the column electrode drive signals during the rest phase. The advantage of using 2-level waveforms for the column electrode drive signals is that simple logic circuit elements such as exclusive-OR gates can be used to produce these signals, and in addition 2-level logic circuits can be more easily implemented by MOS FET integrated circuit elements, with more effective use of chip area than can multi-level signal generating circuits. Thus, since the number of column electrode drive signals which must be produced is generally substantially greater than the number of row electrode drive signals such as TP1, etc, it is preferable to make the column electrode drive signals of 2-level type as in the example of FIG. 7(*a*).

During the first half period shown in FIG. 7(*a*) (e.g. from 0 to T/2), the potentials of the column electrode drive signals are established such as to maximize the value of the ratio Von/Voff, while during the second half-period, these are made identical to the timing signal pulse potentials.

The drive signal waveforms of FIG. 7(*c*) are preferable to those of FIG. 7(*b*) from the aspect of power consumption, since high-frequency drive pulses are not applied to the display electrodes during each rest phase. It should be noted that it would be equally possible to modify the drive signal waveforms of FIG. 7(*c*) such as to set the potentials of both the row electrodes (i.e. TP1, TP2, . . . ) and the column electrodes to zero during each rest phase. In this case, both the column electrode and the row electrode drive signals would be of three-level form, rather than varying only between two levels.

When drive signals for the method of the present invention are produced using a CMOS FET integrated circuit, (abbreviated in the following to CMOSIC), the simplest method of generating multi-level signals is to utilize field-effect transistor switches. However there is a danger of latch-up occurring in this case, due to the reverse voltages generated across the liquid crystal display elements resulting from the capacitances of the display elements. This problem is made more severe by the fact that it is necessary to utilize an increased amplitude of drive signal voltage with the drive method of the present invention (e.g. higher by a factor of $\sqrt{2}$ in the case of a matrix display panel split into two regions). For this reason, it is preferable to apply the drive method of the present invention to a display system in which drive signals are generated by an insulated substrate type of CMOSIC, such as a silicon-on-saphire CMOSIC.

It should be noted that it is not necessary with the drive method of the present invention that the voltage across each display element be reduced precisely to zero during the rest phase, so long as it is sufficiently small by comparison with the voltage appearing across a non-selected display element during the drive phase.

The drive method of the present invention is applicable both to displays of two-level type (i.e. in which each display element is set either fully on or fully off) and to displays which provide a plurality of tone gradations.

It can thus be understood from the above description that the drive method of the present invention enable a liquid crystal matrix display panel to be implemented having a high level of contrast and a substantially greater number of display elements than has been hitherto possible for a matrix display panel which can be inexpensively manufactured and requires only simple peripheral circuits, with no need for a large-capacity video memory. Due to the fact that the drive method of the present invention enables direct line-by-line scanning of the display in an identical manner to that of a conventional CRT display used for raster-type scanning image generation, such a matrix display panel with its associate circuits can be developed into a direct replacement for a CRT display, to produce television, computer or other images.

It should be noted that various changes and modifications can be envisaged for the embodiments described hereinabove for illustrating the method of the present invention, which fall within the scope claimed for the present invention as set out in the appended claims. The above specification should therefore be interpreted in an illustrative and not in a limiting sense.

What is claimed is:

1. A method of driving a liquid crystal display matrix display panel having a plurality of mutually independent row electrodes coupled to receive periodically generated timing signal pulses, applied successively to all of said row electrodes during each of successively occurring scanning field periods, and a plurality of column electrodes coupled to column electrode drive circuit means for receiving in synchronism with said timing signal pulses drive signals representing display data, with a plurality of liquid crystal display elements being formed at intersections of said row electrodes and column electrodes, said column electrodes being divided into at least a first set of column electrodes for driving liquid crystal display elements in a first region of said display panel in conjunction with a first set of said row electrodes and a second set of column electrodes for driving liquid crystal display elements in a second region of said display panel in conjunction with a second set of said row electrodes, said first and second sets of column electrodes being mutually independent, said column electrode drive means being divided into mutually independent first and second column electrode drive means for driving said first and second sets of column electrodes respectively, and wherein each of said regions operates alternately in a drive phase, during a specific portion of said scanning field period, in which drive signals are applied to the column electrodes thereof and timing signal pulses are applied sequentially to select the row electrodes thereof, and a rest phase, during another portion of said scanning field period, in which a potential substantially equal to zero is applied across all of the display elements thereof, and wherein while one of said regions is operating in said rest phase the other one of said regions is operating in said drive phase.

2. A drive method according to claim 1, in which said potential substantially equal to zero in said rest phase is established by setting the potentials of the column electrodes and row electrodes of a region operating in said rest phase to identical values.

3. A drive method according to claim 1, in which said potential substantially equal to zero in said rest phase is is established by employing switching elements to apply a short-circuit between the column electrodes and row electrodes of a region operating in said rest phase.

4. A drive method according to claim 1, in which said timing signal pulses applied to drive said row electrodes vary between at least three different potentials and in which said drive signals applied to said column electrodes vary between two different potentials.

5. A drive method according to claim 1, in which said timing signal pulses applied to drive said row electrodes and said drive signals applied to said column electrodes each comprise trains of pulses of alternating polarity, with the pulse train of said timing signal pulses being identical in polarity to that of said column electrode drive signals.

6. A drive method according to claim 1, in which said drive circuit means of said row electrodes and column electrodes comprise complementary field-effect transistor switches formed in a monolithic integrated circuit.

7. A drive method according to claim 6, in which said monolithic integrated circuit is of insulated-substrate configuration.

8. A drive method according to claim 6, in which said monolithic integrated circuit comprises a silicon-on-saphire substrate.

9. A drive method according to claim 1, in which multiplexed driving of said row electrodes and column electrodes is employed, with each column of said display elements being driven by a plurality of sets of column electrodes, and with each of said row electrodes serving to drive a corresponding plurality of rows of said display elements.

* * * * *